US007879159B2

(12) United States Patent
Wright et al.

(10) Patent No.: US 7,879,159 B2
(45) Date of Patent: Feb. 1, 2011

(54) MARTENSITIC STAINLESS STEEL STRENGTHENED BY $NI_3TI$ η-PHASE PRECIPITATION

(75) Inventors: James Wright, Chicago, IL (US); Jin-Won Jung, Skokie, IL (US)

(73) Assignee: QuesTek Innovations, LLC, Evanston, IL (US)

( * ) Notice: Subject to any disclaimer, the term of this patent is extended or adjusted under 35 U.S.C. 154(b) by 401 days.

(21) Appl. No.: 11/814,780

(22) PCT Filed: Jan. 25, 2006

(86) PCT No.: PCT/US2006/002896

§ 371 (c)(1),
(2), (4) Date: Dec. 3, 2007

(87) PCT Pub. No.: WO2006/081401

PCT Pub. Date: Aug. 3, 2006

(65) Prior Publication Data

US 2008/0314480 A1 Dec. 25, 2008

Related U.S. Application Data

(60) Provisional application No. 60/646,805, filed on Jan. 25, 2005.

(51) Int. Cl.
*C22C 38/50* (2006.01)
*C22C 38/52* (2006.01)
*C22C 38/44* (2006.01)

(52) U.S. Cl. ..... 148/325; 148/326; 148/327; 148/328; 148/335; 420/38; 420/53; 420/57; 420/68; 420/107; 420/109

(58) Field of Classification Search ..... 148/325–328, 148/607, 608, 335; 420/38, 53, 57, 68, 107, 420/109
See application file for complete search history.

(56) References Cited

U.S. PATENT DOCUMENTS

| | | | |
|---|---|---|---|
| 3,251,683 | A | 5/1966 | Hammond |
| 4,514,235 | A | 4/1985 | Augustin et al. |
| RE36,382 | E | 11/1999 | Hultin-Stigenberg |
| 6,630,103 | B2 | 10/2003 | Martin et al. |

FOREIGN PATENT DOCUMENTS

JP 63-134648 A 6/1988

OTHER PUBLICATIONS

Acta Materialia 52 (2004) 1023-1037—Precipitation hardening in a 12% Cr-9%Ni-4%Mo-2%Cu stainless steel by Matshattestrand, et al. , Jan. 8, 2003.

*Primary Examiner*—Deborah Yee
(74) *Attorney, Agent, or Firm*—Banner & Witcoff

(57) ABSTRACT

A precipitation-hardened stainless maraging steel which exhibits a combination of strength, toughness, and corrosion resistance comprises by weight about: 8 to 15% chromium (Cr), 2 to 15% cobalt (Co), 7 to 14% nickel (Ni), and up to about 0.7% aluminum (Al), less than about 0.4% copper (Cu), 0.5 to 2.6% molybdenum (Mo), 0.4 to less than about 0.75% titanium (Ti), up to about 0.5% tungsten (W), and up to about 120 wppm carbon (C), the balance essentially iron (Fe) and incidental elements and impurities, characterized in that the alloy has predominantly lath martensite microstructure essentially without topologically close packed intermetallic phases and strengthened primarily by a dispersion of intermetallic particles primarily of the eta-Ni3Ti phase and wherein the titanium and carbon (Ti) and (C) levels are controlled such that C can be dissolved during a homogenization step and subsequently precipitated during forging to provide a grain-pinnning dispersion.

20 Claims, 9 Drawing Sheets

Time – temperature schematic illustrating processing steps for the subject alloys.

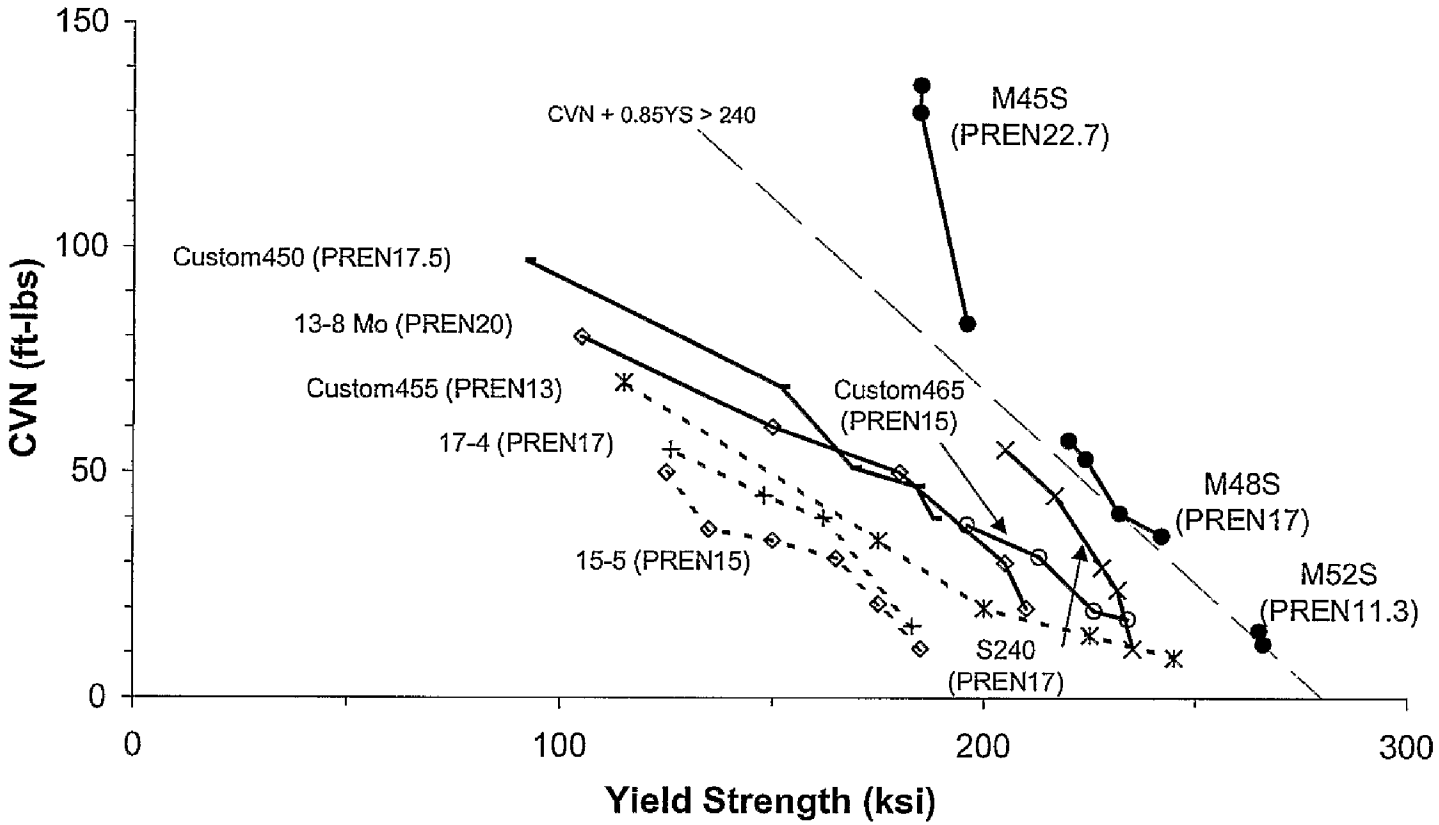
Figure 1. Impact toughness vs. yield strength for precipitation strengthened martensitic stainless steels.

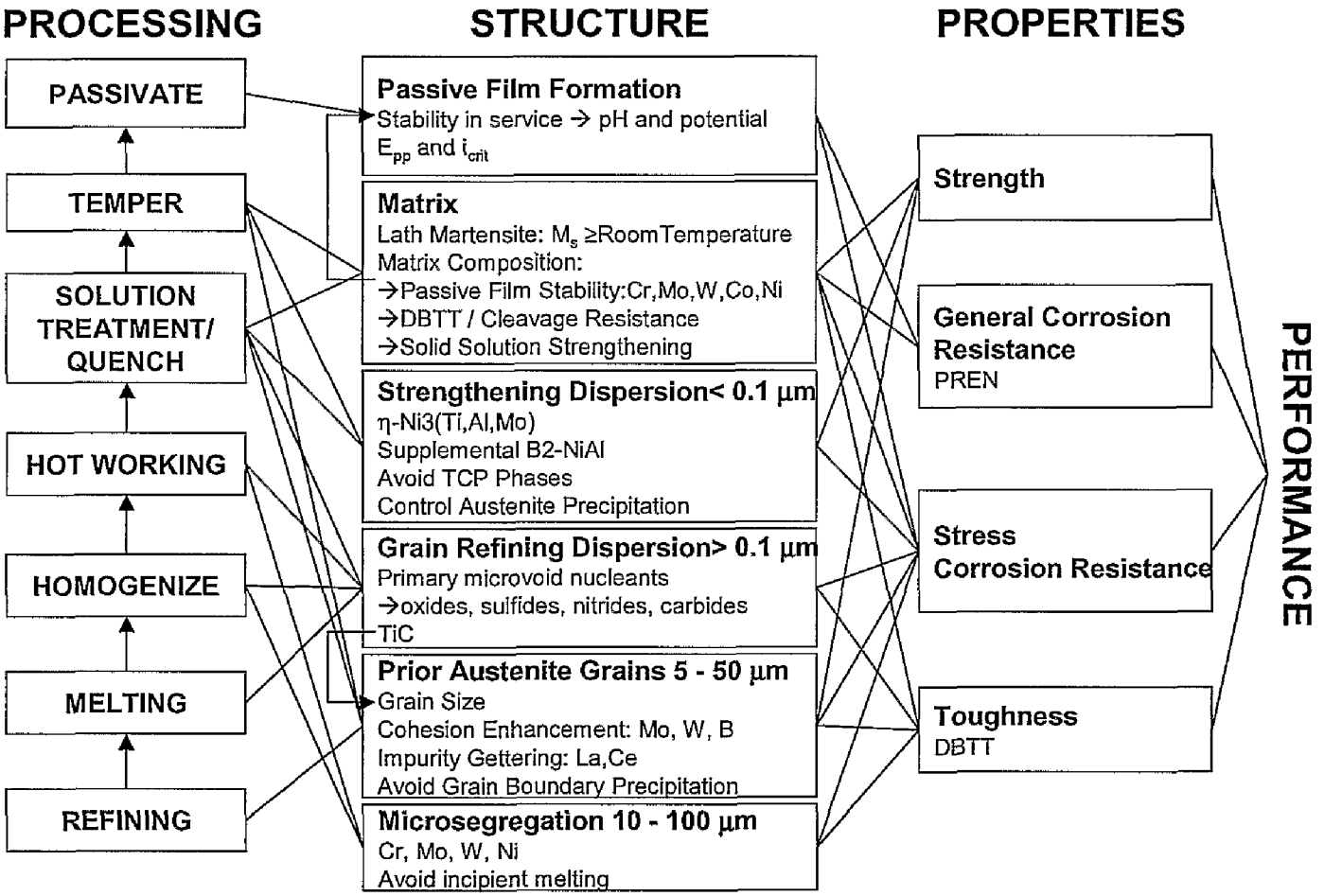
Figure 2. System Design Chart illustrating processing – structure – property relationships.

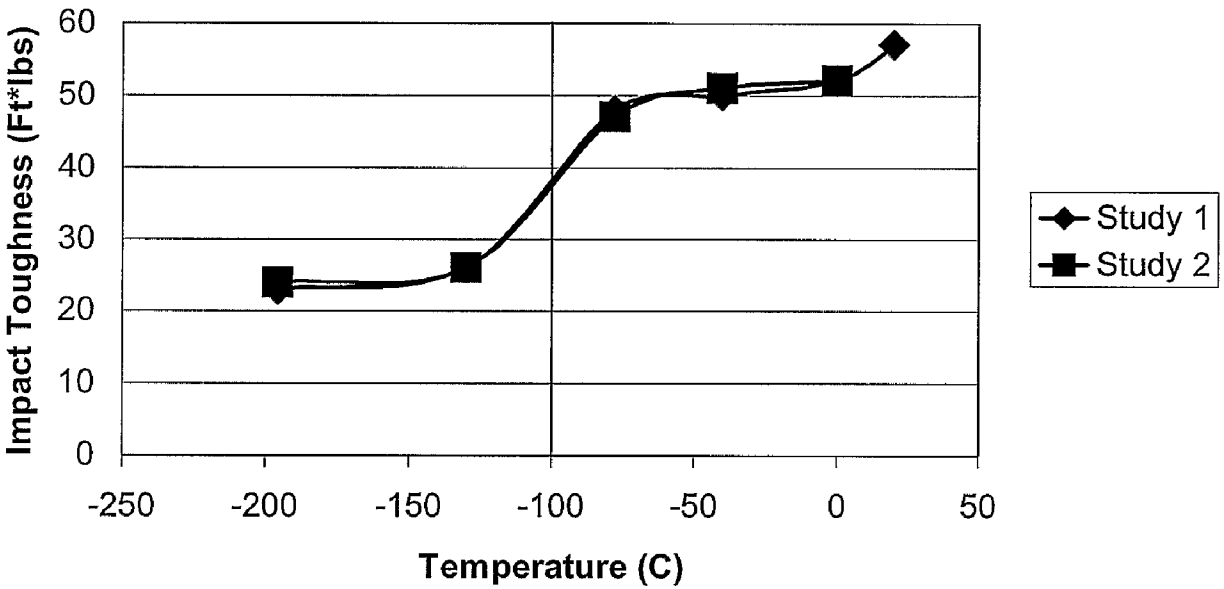
Figure 3. Charpy V-notch impact energy as a function of test temperature for M48S-1A composition, illustrating toughness to cryogenic temperatures.

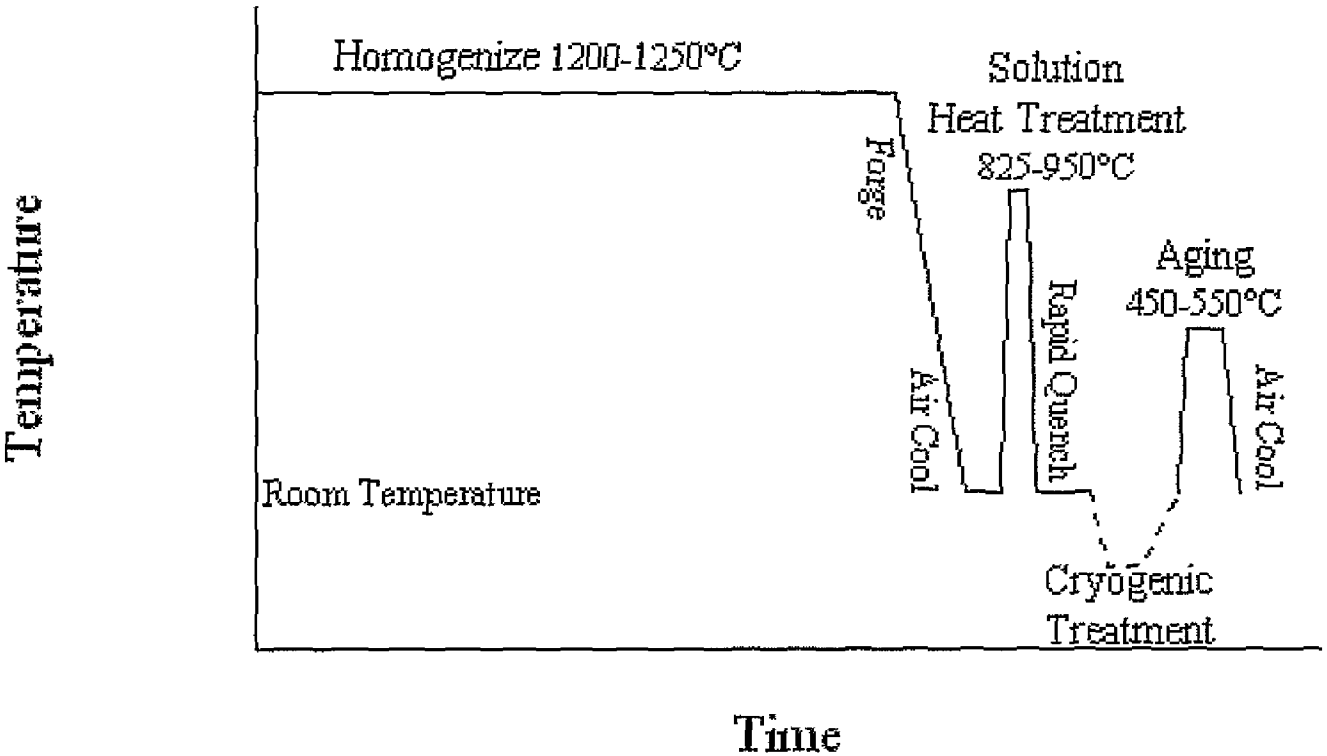
Figure 4. Time – temperature schematic illustrating processing steps for the subject alloys.

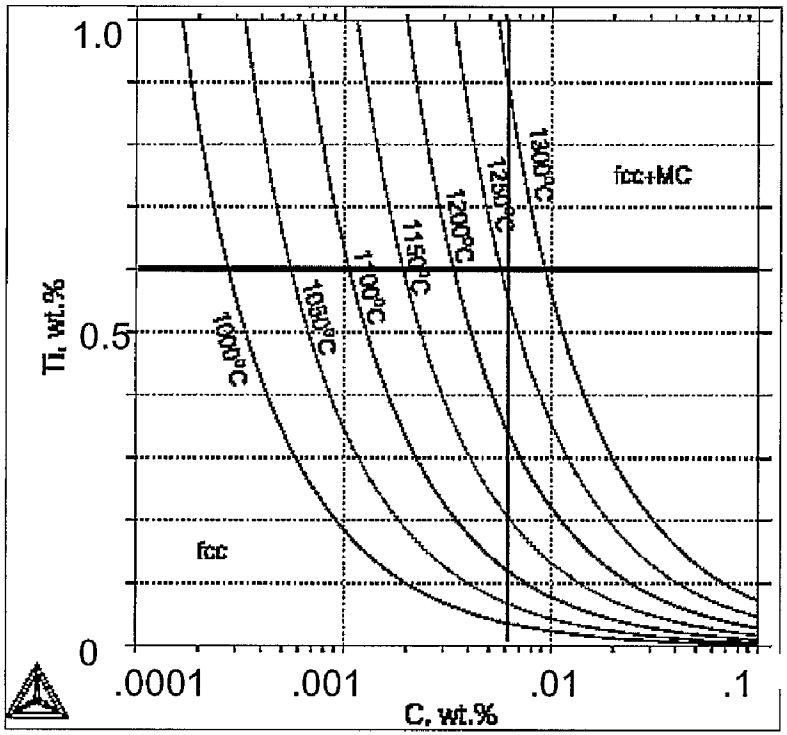
Figure 5. MC carbide solvus temperature contours as function of Ti and C contents. Ti and C are shown in units of wt%, and temperature contours are shown in units of °C. Calculated for M48S-1A composition.

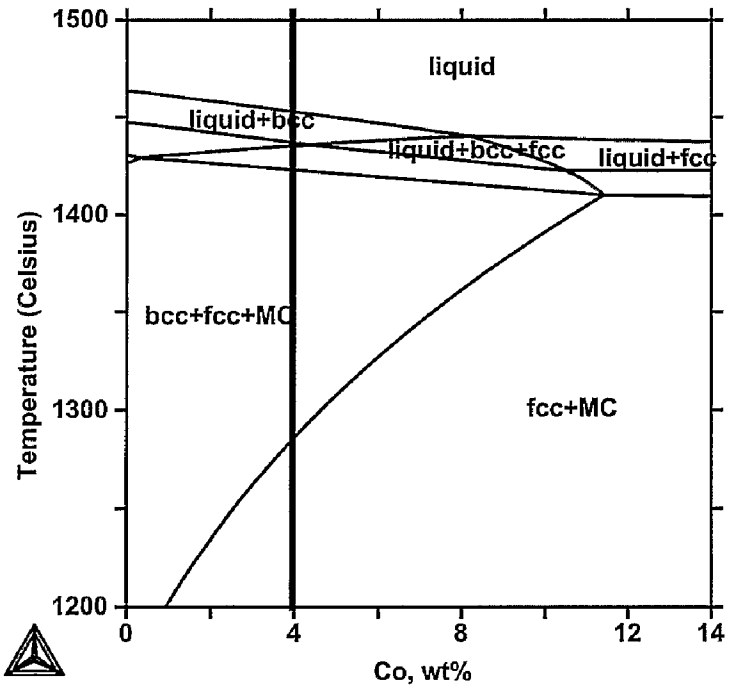
Figure 6. Effect of Co to avoid high temperature delta ferrite (BCC) at homogenization temperature. Calculated for M45S-1A composition.

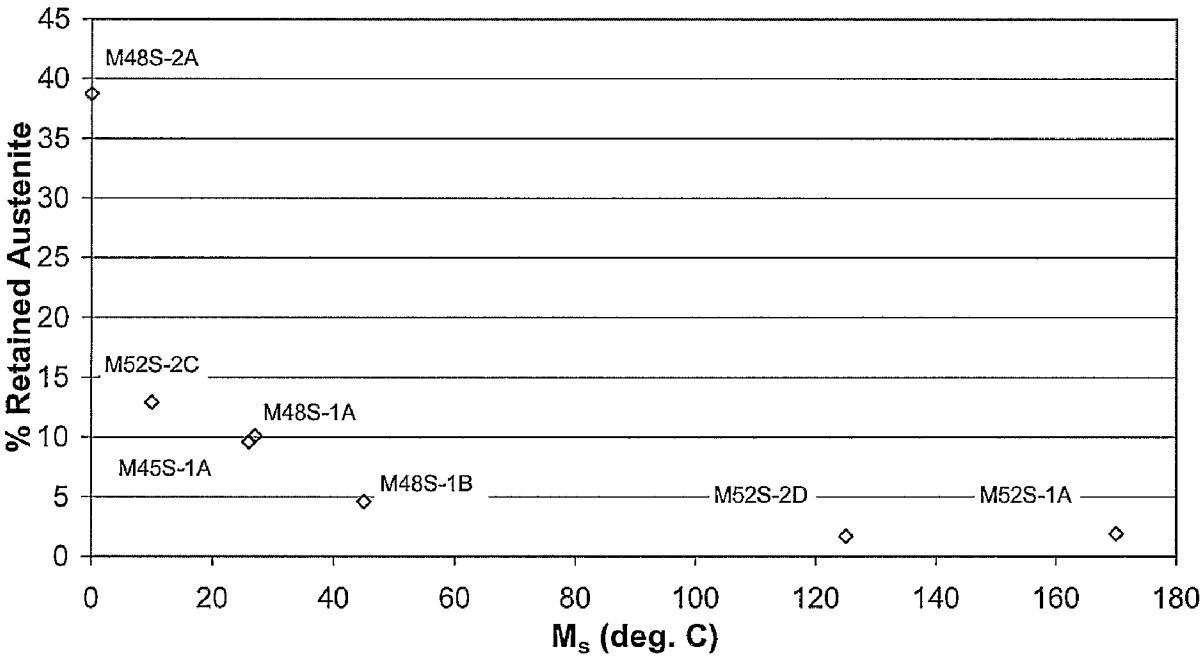
Figure 7. Retained austenite content vs. martensite start temperature measured for alloys illustrating increased retained austenite with lower $M_S$.

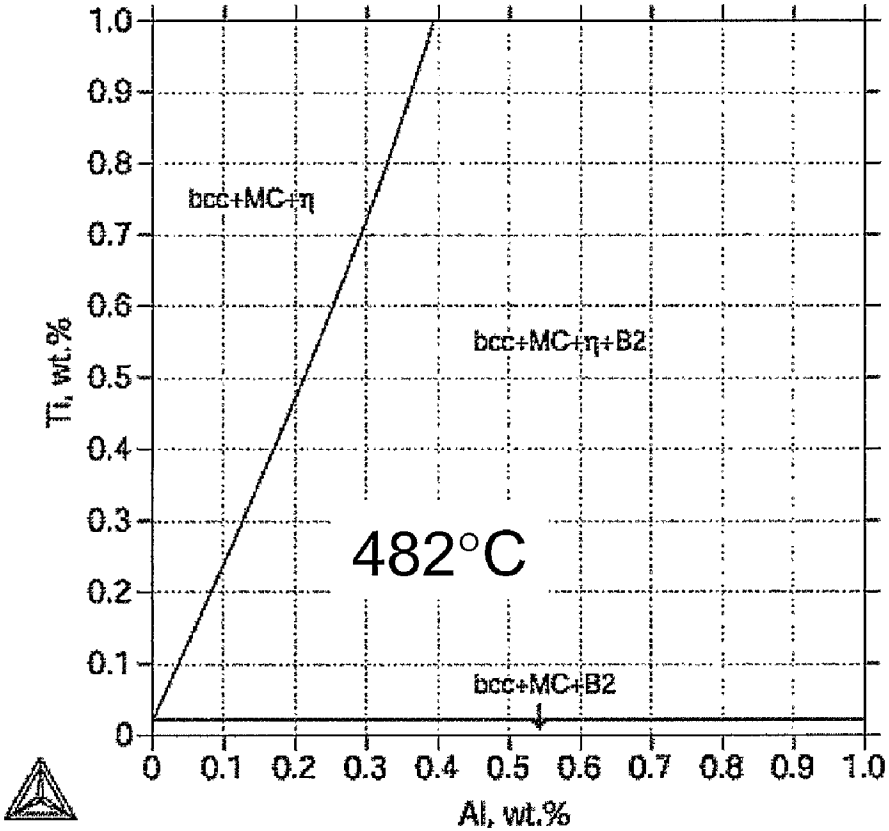
Figure 8. Ti – Al quasi-binary phase diagram illustrating solubility of Al in $Ni_3Ti$ η phase. Calculated at 482°C for M52S-1A composition.

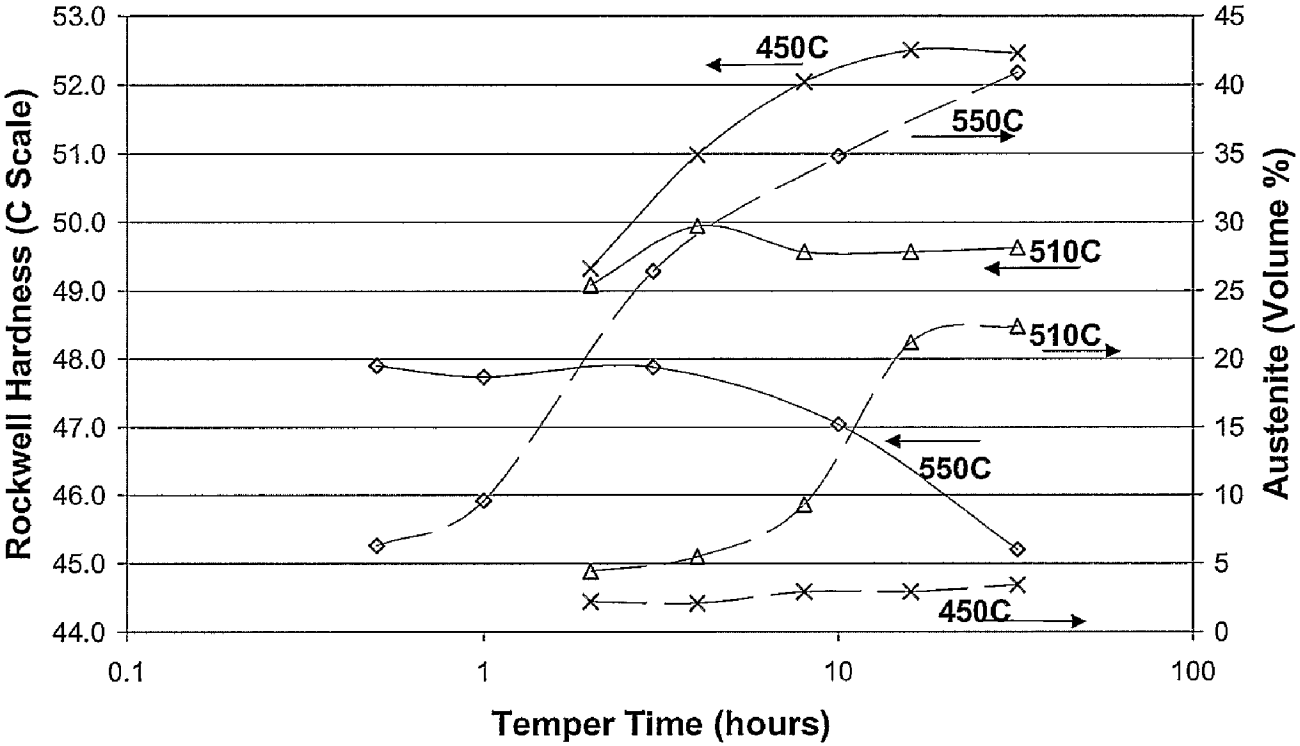
Figure 9. Measured hardness and austenite fraction for M52S-1A, illustrating decreased hardness with increased austenite volume fraction.

MARTENSITIC STAINLESS STEEL STRENGTHENED BY $NI_3TI$ η-PHASE PRECIPITATION

CROSS REFERENCE TO RELATED APPLICATIONS

This is an international application based upon the following provisional application which is incorporated herewith by reference and for which priority is claimed: U.S. Ser. No. 60/646,805, filed Jan. 25, 2005, "Martensitic Stainless Steel Strengthened by $Ni_3Ti$ η-Phase Precipitation."

REFERENCE TO RESEARCH GRANTS AND GOVERNMENT LICENSE

Activities relating to the development of the subject matter of this invention were funded at least in part by United States Government, United States Marine Corps SBIR contracts M67854-04-C-0029 and M67854-05-C-0025 and United States Navy SBIR contracts N00421-03-P-0062 and N00421-03-C-0091, and thus may be subject to license rights and other rights in the United States.

BACKGROUND OF THE INVENTION

In a principal aspect, the present invention relates to interstitial-free chromium, nickel, cobalt, molybdenum, titanium, aluminum stainless martensitic steels having an excellent combination of strength, toughness, and corrosion resistance across a variety of strength levels.

Martensitic steels exhibit high strength and toughness due to the fine sub-grain structure that forms as a result of the phase transformation from austenite at high temperature to martensite at low temperature. Martensitic steels can be classified as either containing interstitial atoms such as carbon or nitrogen, or essentially interstitial-free. Non-stainless interstitial-free maraging steels have been developed since the 1960's, and usually contain about 18 wt % Ni and substitutional elements such as Co, Mo, and Ti. The Ni content in these steels contributes to a good strength-toughness combination, by (1) increasing the thermodynamic driving force for η nucleation and thereby optimally reducing the η particle size for efficient strengthening; and (2) decreasing the Ductile-to-Brittle Transition Temperature (DBTT) and improving the matrix toughness. There are two grades in non-stainless maraging steels: C-grades, such as C-200, -250, -300, and -350; and T-grades, such as T-200, -250, and -300, where the number stands for the approximate tensile strength, in units of ksi. The C-grade contains Co and achieves higher strength for equivalent η phase fraction than the T-grade, which is free of Co and contains a higher amount of Ti. The improved strengthening efficiency of C-grade can be attributed to the reduced η particle size, which is achieved by an increased thermodynamic driving force.

Alloys can generally be considered stainless when the thermodynamic activity of Cr is sufficient to produce a stable chromic oxide passive film that prevents further corrosion. Mo and W are known to further improve the pitting corrosion resistance. However, the addition of these elements reduces the martensite start temperature ($M_s$). To ensure a reasonable $M_S$, a balance of alloying elements, particularly Cr, Ni, Cu, and Mo, is required. A series of existing stainless maraging steels have established examples of an acceptable balance: PH 17-7, 17-4PH, 15-5PH, PH 13-8, Custom 450, Custom 455, Custom 465, S240, Marval X12, Vasco734, and XPH12-9. The Cr, Ni, Cu, and Mo contents of these alloys are shown in Table 1 along with the precipitated strengthening phases.

TABLE 1

| Alloy | Cr | Ni | Cu | Mo | Others | Strengthening Phases |
|---|---|---|---|---|---|---|
| 17-4PH | 17 | 4 | 4 | | | bcc-Cu |
| 15-5PH | 15 | 5 | 3.5 | | | bcc-Cu |
| Custom 450 | 15 | 6 | 1.5 | 0.75 | 1Nb | bcc-Cu |
| S240 | 12 | 9 | 2 | 1.5 | 1.2Al, 0.3Ti | bcc-Cu + B2-NiAl |
| XPH12-9 | 12 | 9 | 1.2 | 1.5 | 1.6Al | B2-NiAl + bcc-Cu |
| PH 13-8 | 13 | 8 | | 2 | 1.1Al | B2-NiAl |
| PH 17-7 | 17 | 7 | | | 1.1Al | B2-NiAl |
| Vasco734 | 12 | 10.5 | | | 1.25Al, 0.4Ti | B2-NiAl + η |
| Marval X12 | 12 | 9 | | 2 | 0.7Al, 0.3Ti | B2-NiAl + η |
| Custom 465 | 12 | 11 | | 1 | 1.6Ti | η |
| Custom 455 | 12 | 8.5 | 2 | | 1Ti, 0.5Nb | η + bcc-Cu |

From this array of alloy compositions, trade-offs between alloying elements can be noticed in maintaining a high $M_S$ to complete the martensitic transformation at room temperature. Some alloys, such as Custom 465, require an additional cryogenic treatment to complete the transformation. Stainless maraging steels that cannot be processed by vacuum melting to large-scale ingots are shown in Table 2. The $M_S$ of Nanoflex is too low and necessitates a sub-zero isothermal martensitic transformation and/or heavy cold working after quenching to complete the martensitic transformation, limiting its geometry to wire or blade with thin cross-section. Custom 475 [U.S. Pat. No. 6,630,103 (incorporated herewith)] is limited in ingot size due to solidification segregation problems.

TABLE 2

| Alloy | Cr | Ni | Cu | Mo | Others | Strengthening Phases |
|---|---|---|---|---|---|---|
| Custom 475 | 11 | 8 | | 4.5 | 9Co, 1.2Al | B2-NiAl + TCP |
| Nanoflex | 12 | 9 | 2 | 4 | 0.9Ti, 0.3Al | η + bcc-Cu + TCP (R phase) |

The alloys listed in Tables 1 and 2 can be characterized according to their strengthening phases that are precipitated during aging. The three most common and effective strengthening phases are η, B2-NiAl, and bcc-Cu. The bcc-Cu and B2-NiAl phases are both ordered-bcc phases with considerable inter-solubility, and can nucleate coherently in the bcc martensitic matrix, thereby providing fine-scale dispersion. Some solubility of Ti in B2-NiAl is expected, and at prolonged tempering times, a highly ordered Heusler phase $Ni_2TiAl$ may form.

The η-$Ni_3Ti$ phase is believed to have the smallest optimum particle size among intermetallic precipitates in steel, and therefore is most efficient for strengthening. This strengthening efficiency minimizes the debit of nickel in the matrix and thereby suppresses the DBTT. For this reason, the η phase is utilized for strengthening the non-stainless, interstitial-free martensitic C-grade and T-grade steels where high alloy Ni contents are easily obtained with high $M_S$ temperatures.

Besides the B2, bcc-Cu, and η strengthening phases, low-symmetry, Topographically Close-Packed (TCP) phases such as R, Laves, or μ may provide some strengthening response, although at the expense of alloy ductility. Precipitation of soft austenite particles may reduce the strength of the alloy. Finally, a small strengthening response may be obtained from precipitation of coherent, nano-scale bcc-Cr particles during tempering. However, the effect of nano-scale bcc-Cr precipitates on dislocation motion and therefore mechanical properties are expected to be small.

Maraging steels may also be characterized by their strength-toughness combinations. FIG. 1 illustrates the strength—toughness combinations of a variety of commercial stainless maraging alloys, together with examples of the subject invention as discussed hereinafter. The alloys strengthened by bcc-Cu generally exhibit a yield strength of 140-175 ksi. The B2 strengthened PH13-8 alloy has good corrosion resistance and can achieve a yield strength up to about 200 ksi. The PH13-8 SuperTough® alloy has been developed by Allvac to increase the toughness of the alloy by minimizing O, N, S, and P, while maintaining strength. Additional alloys have been developed to achieve yield strength up to about 240 ksi, however their impact toughness decreases dramatically above about 235 ksi. Stainless maraging steels capable of achieving a yield strength greater than about 255 ksi are Custom475 and NanoFlex, however both suffer from aforementioned processing issues.

Maraging steels may also be characterized by corrosion resistance. Pitting Resistance Equivalence Number (PREN) is a commonly used parameter to estimate corrosion resistance. While PREN does not consider the microstructural effects on specific corrosion mechanisms, it is effective when comparing similar microstructures. PREN is defined as wt % Cr+3.3*(wt % Mo+½ wt % W), and is incorporated as a design parameter in the subject invention.

The stainless maraging steels Custom465 by Carpenter Technologies and NanoFlex, also referred to as 1RK91 by Sandvik steels employ a strengthening η phase. However, NanoFlex is specified with greater than 0.5 wt % Cu in the alloy, while Custom465 has a higher Ti content and does not contain any Co.

Two other patented alloys have shown similar strength-toughness combinations. First, Custom475 includes very high Al and Mo contents. This alloy demonstrated high strength-toughness properties, however, it can only be produced in small section sizes [U.S. Pat. No. 6,630,103, column 5, lines 46-58]. Second, a patent from Allvac for PH13-8 SuperTough describes how to make the existing, non-proprietary alloy, PH13-8 with higher toughness. However, the composition of PH13-8 SuperTough has very low Ti content.

NanoFlex must be plastically deformed to complete the martensitic transformation [U.S. Pat. RE36,382 (incorporated herewith)]. NanoFlex is suitable only for small-dimension applications, and utilizes Cu primarily to achieve the desired ductility, but also to achieve the desired tempering response.

Thus, there has remained the desire for a sizable high strength, tough stainless steel alloy.

SUMMARY OF THE INVENTION

In a principal aspect, the subject invention comprises a martensitic stainless steel alloy, precipitation strengthened by a dispersion of intermetallic particles primarily of the $Ni_3Ti$ η-phase. Supplemental precipitation strengthening may be contributed by a dispersion of coherent bcc-Cr and/or B2-NiAl particles. During tempering, austenite precipitation is controlled, and precipitation of embrittling TCP phases is avoided. The Ti and C levels are controlled such that C can be dissolved during homogenization and subsequently precipitated during forging to provide a grain-pinning dispersion of MC carbides, where M is Ti, V, Nb, or Ta. The composition is selected such that during homogenization, the alloy will be in the single-phase field of fcc, while avoiding δ-ferrite. The composition is also selected such that $M_S$, and therefore the volume fraction of retained austenite, is balanced with other alloy design constraints. For a given strength level, the corrosion resistance of the alloy, as quantified by PREN, is maximized. The cleavage resistance of the alloy is maintained at cryogenic temperatures through a careful control of the tempered matrix composition.

The alloys of the subject invention with the aforementioned microstructural features are suitable for production of large-scale ingots using conventional processing techniques known to persons skilled in the art. The alloys can be subsequently forged, following a homogenization treatment. The alloys are designed to transform to the desired martensite phase constitution of greater than about 85% upon quenching from high temperature without requiring cold work. For some applications, the alloys can be investment-cast in vacuum to near-net shape parts. Due to the lower solid-solution strengthening effect of substitutional elements such as Al, Co, Cr, Mo, Ni, or Ti, compared to interstitial elements such as C or N, as-quenched interstitial-free martensitic steels of the subject invention are relatively soft and therefore more easily machined than carbon-containing martensitic steel.

The alloys with the microstructural concept described above and subject to the desired processing constraints have been designed across a range of yield strength from 180 up to 270 ksi. At these strength levels, the impact toughness ranges from 10 to 160 ft-lbs according to the relationship illustrated in FIG. 1. For a given strength and toughness level the general corrosion resistance and Stress-Corrosion Cracking (SCC) resistance are maximized. Furthermore, for some embodiments, high impact toughness has been demonstrated even at −100° C.

The optimum composition range across which the microstructural concept can be achieved to meet the processing constraints and reach the property objectives are shown in Table 3. Three embodiments, targeting three different strength levels at associated toughness and corrosion resistance trade-offs, are presented in comparison to composition ranges of commercial alloys.

TABLE 3

| Alloy | Cr | Ni | Co | Cu | Mo | W | Ti | Al | C |
|---|---|---|---|---|---|---|---|---|---|
| PH13-8 SuperTough | 12.25-13.25 | 7.5-8.5 | 0 | 0 | 2-2.5 | 0 | 0 | 1.1 | |
| Preferred | 13 | 8 | 0 | 0 | 2 | 0 | 0 | 1.1 | |
| Custom465 | 10-13 | 10.5-11.6 | 0 | 0-0.95 | 0.25-1.5 | 0 | 1.5-1.8 | 0-0.25 | |
| Preferred | 11.75 | 11 | 0 | 0 | 1 | 0 | 1.6 | 0 | |
| Custom475 | 9-13 | 7-9 | 5-11 | 0-0.75 | 3-6 | 0 | 0-1.0 | 1.0-1.5 | |

TABLE 3-continued

| Alloy | Cr | Ni | Co | Cu | Mo | W | Ti | Al | C |
|---|---|---|---|---|---|---|---|---|---|
| Preferred | 11 | 8 | 9 | 0 | 4.5 | 0 | 0 | 1.2 | |
| NanoFlex | 10-14 | 7-10 | 0-9 | 0.5-4 | 0.5-6 | 0 | 0.4-1.4 | 0.05-0.5 | |
| Preferred | 12 | 9 | 0 | 2 | 4 | 0 | 0.9 | 0.3 | |
| S240 | 11-12.5 | 9-11 | 0 | 0.5-2.5 | 1-2.5 | 0-2 | 0.15-0.5 | 0.7-1.5 | 0-0.02 |
| Preferred | 9.5 | 11.5 | 0 | 1.5 | 1.5 | 0.75 | 0.3 | 1.1 | 0.012 |
| Subject Alloy | 8-15 | 7-14 | 2-15 | 0-0.4 | 0.5-2.6 | 0-0.5 | 0.4-0.75 | 0-0.7 | 0.002-0.015 |
| M45S embodiment | 12-15 | 7-10 | 2-8 | 0-0.4 | 1.5-2.6 | 0-0.5 | 0.4-0.6 | 0.1-0.4 | 0.002-0.015 |
| M48S embodiment | 10-13 | 8.5-11 | 4-10 | 0-0.4 | 1-2 | 0-0.5 | 0.45-0.65 | 0.2-0.6 | 0.002-0.015 |
| M52S embodiment | 8-11 | 10-14 | 6-15 | 0-0.3 | 0.5-1.5 | 0-0.5 | 0.55-0.75 | 0.3-0.7 | 0.002-0.015 |

There are many structural engineering applications that can benefit from stainless steels with improved combinations of strength, toughness, and corrosion resistance. Aircraft landing gears that require high tensile strength with excellent resistance to SCC are currently made of non-stainless steels such as 300M and AerMet100, because stainless steels do not meet the demanding performance requirement. To minimize the SCC susceptibility, non-stainless steels must be coated with toxic cadmium. Stainless steels of the subject invention eliminate the need for cadmium coating without a debit in mechanical properties. Novel weight-efficient designs of other structural aeroframe components such as flap tracks, actuators, or engine mounts are also enabled by improved strength-toughness combinations of the subjection invention. The firepower of gun barrels which are limited by material yield strength and further suffer from erosion can be improved by employing stainless steels of the subject invention. Down-hole petrochemical drilling components requiring high strength such as chokes, valve internals, and tubing hangers also benefit from stainless of the subject invention. The precipitation-hardened martensitic stainless steel of subject invention with good sulfide stress cracking resistance and higher strength enable novel space-efficient designs of these components and prolong the sustainability of the oil and gas supply. Biomedical applications may also benefit from steels of the subject invention with superior strength-corrosion resistance combination.

These objectives, characteristics, and uses among others are set forth in further detail in the description which is set forth hereinafter.

BRIEF DESCRIPTION OF THE DRAWING

In the detailed description which follows reference is made to the following figures:

FIG. 1 is a graph of impact toughness vs. yield strength for precipitation-hardened martensitic stainless steels;

FIG. 2 is a systems design chart illustrating processing-structure-property relationships for the present invention;

FIG. 3 shows Charpy V-notch impact energy as a function of test temperature for M48S-1A prototype alloy;

FIG. 4 shows the time-temperature processing steps schematically for the subject alloy;

FIG. 5 shows MC carbide solvus temperature contours as function of Ti and C contents for the M48S-1A composition. Ti and C are shown in units of wt %, and temperature contours are shown in units of ° C.;

FIG. 6 shows the effect of Co to avoid high temperature δ-ferrite (BCC) at homogenization temperature for M45S-1A alloy;

FIG. 7 shows measured retained austenite content vs. measured $M_S$ for prototype alloys, illustrating the effect of increased retained austenite with reduced $M_S$;

FIG. 8 shows Ti—Al quasi-binary phase diagram illustrating solubility of Al in η-$Ni_3Ti$ phase, calculated for the M52S-1A alloy; and FIG. 9 shows measured hardness and austenite volume fraction for M52S-1A prototype alloy, illustrating the decrease in hardness with increased austenite volume fraction.

DETAILED DESCRIPTION OF THE EMBODIMENTS

Systems Design Chart

The processing-structure and structure-property relationships considered important for the alloys are illustrated in FIG. 2. This alloy systems design chart depicts the various length scales of microstructural sub-systems and their effects on alloy properties. For the subject invention, key properties include yield strength and ultimate tensile strength; impact toughness; and PREN. The preferred processing steps are shown in the left of the design chart, and the affected microstructural features during each processing step are shown with arrows.

Properties

Strength is a primary design factor for many components that would be fabricated from the alloys. For a given alloy, strength is inversely proportional to toughness. In addition, Cr and Mo contents useful for corrosion resistance are also delicately balanced for $M_S$, creating another inverse relationship of strength to corrosion resistance. Thus the strength for any particular alloy was designed at a concomitant toughness and corrosion resistance, and successfully validated, as depicted in FIG. 1.

Five primary microstructural features are considered important to achieve efficient strengthening. First, the alloy requires a fine grain size that can be achieved via forging, and optimal MC grain-refining dispersion, where M is Ti, V, Nb, or Ta. Second, the alloy must have a predominantly lath martensitic subgrain structure upon quenching from the solution heat treatment, with less than about 15% retained austenite. Third, within the tempered martensitic matrix, η-phase precipitates must provide efficient strengthening. Fourth, austenite precipitation must be carefully controlled, since such particles can reduce strength. Finally, Ni, Co, Cr, Mo, and W remaining in the martensitic matrix must provide effective solid solution strengthening.

Charpy V-Notch (CVN) impact toughness has been the primary measure of toughness for prototypes of the invented alloys. As illustrated in FIG. 1, for any given yield strength and corrosion resistance, the impact toughness of the alloys is superior to currently available interstitial-free martensitic stainless steel. The steels of subject invention achieve a value of CVN+0.85× (Yield Strength) greater than about 240, where CVN is in ft·lb and yield strength in ksi. Impact toughness has been measured at varying test temperatures to characterize DBTT and verify the alloy susceptibility to cleavage at low temperatures for M48S-1A prototype, as shown in FIG. 3.

Several microstructural features are considered important factors for designing high toughness alloys a given strength level. As with strength, it is important to achieve a fine-grain microstructure and predominantly martensitic substructure while minimizing retained austenite to less than about 15% by volume. TiC particles that cannot be dissolved during homogenization should be avoided. Primary microvoid-forming inclusions should be minimized by controlling O, N, S, and P during melting. During tempering, TCP-phase precipitation should be avoided because these can reduce the alloy ductility and toughness. Finally, the tempered martensite matrix composition will determine DBTT, where Ni is the most potent element for promoting ductile fracture.

PREN has been utilized as the primary measure of corrosion resistance for the alloys. This can be conveniently calculated from the alloy composition. The steels of subject invention achieve a value of PREN+0.12× (Yield Strength) greater than about 44, where yield strength is in ksi. Corrosion resistance is primarily achieved via a self-healing, passive chromic-oxide surface layer. Cr, Mo, and W in the martensitic matrix enable the formation of this passive oxide layer. Therefore Cr-rich particles and (W, Mo, Cr)-rich TCP phases should be avoided for corrosion resistance if possible. In some instances, bcc-Cr may be needed for strength, however TCP-phase precipitation should be avoided. Partitioning of Mo and W to grain and sub-grain boundaries during tempering can reduce the alloy susceptibility to intergranular SCC. Reduced grain size is also beneficial to reduce the susceptibility to SCC.

Processing

The alloys are designed to be conventionally processed according to, for example, a time-temperature schematic shown in FIG. 4. Certain problems may arise when processing alloy-rich steels, and to avoid such problems, composition limitations and processing recommendations are applicable to the subject alloys as represented by FIG. 4 and discussed hereinafter.

First, high purity elements are induction melted in vacuum (VIM) to achieve low impurity levels of O, N, S, P, and tramp elements. S and P are known to segregate to austenite grain boundaries and thereby reduce alloy toughness or increase the SCC susceptibility. Minor additions of Ca, La, rare earth elements, or other reactive elements lmown to getter these embrittling elements can similarly minimize grain-boundary segregation. O and N are known to form embrittling oxide and nitride inclusions, and the reduction of these elements would increase alloy toughness. For the η-strengthened alloys of the subject invention, it has been discovered that C content should also be carefully controlled to avoid the formation of large, insoluble titanium carbide or titanium carbo-sulfide particles during solidification.

Following VIM, the ingot may then be Vacuum Arc-Remelted (VAR) to achieve a more refined cast microstructure. Alternatively, the alloy may be vacuum investment-cast to near net shape.

Segregation occurs during VIM process due to composition differences between dendrites and the remaining liquid. To reduce composition fluctuation from solidification, the alloy should be held in the high temperature fcc single-phase field. The duration of this treatment will depend on the ingot cooling rate and magnitude of segregation in the ingot, but it has been discovered that 8 to 32 hours is generally sufficient. Alloy carbon content should be low enough that all TiC phase may be dissolved in the fcc matrix at a practical homogenization temperature. This provides a-limit on Ti content. FIG. 5 shows contours of calculated TiC solvus temperatures as a function of alloy Ti and C contents. A Ti level of 0.5 to 0.75 wt % has been discovered as optimum to allow about 20 to 150 wppm and preferably 50 to 100 wppm C to be dissolved at 1250° C. While the TiC particles are dissolved during this treatment, very small fractions of rare earth gettered O, N, S, P inclusions may remain in the alloy undissovled.

To further refine the microstructure, the homogenized ingot is forged at temperatures below the TiC solvus temperature in the TiC+fcc two phase field, where the TiC particles to act as a grain-refining dispersion. The small particle size of precipitated TiC maximizes the grain-refining efficiency and limits growth of recrystallized austenite grains during subsequent solution heat treatment.

During forging, incipient melting can cause severe problems, such as hot shortness or edge checking. Incipient melting is the result of incomplete homogenization where a liquid pool forms at low-melting eutectic compositions. Interactions between Ti and C to form TiC from the melt during solidification is responsible for this problem, and the recommended Ti and C limits avoid this.

Investment-cast components are not normally forged, and therefore will have a coarser microstructure than forged components. Precipitation of a fine TiC grain-refining dispersion via exposure to the TiC+fcc two-phase field is desired to pin the recrystallized austenite grain boundaries during subsequent solution heat treatment.

Following cooling from the forging process (or homogenization and TiC precipitation for investment-cast components) the alloy shall be solution-treated to dissolve intermetallic phases, but the time and temperature of exposure shall be limited to minimize the coarsening of the grain-refining TiC dispersion and therefore limit austenite grain growth. The component should typically be cooled to room temperatures reasonably quickly to promote the martensitic transformation. A quick cryogenic treatment may be employed to further reduce the fraction of retained austenite.

After solution heat treatment, the alloy may be machined in a relatively soft state.

Subsequent tempering results in precipitation of second-phase particle dispersions within the alloy. For each alloy composition and desired properties, recommended or controlled tempering times and temperatures are suggested to achieve optimal microstructures. The principal phase precipitated in the subject alloys is the $Ni_3Ti$ η-phase for efficient strengthening. The particle size of the η-phase precipitates is optimally reduced such that higher strength is achieved in the alloys, compared to Custom465 that contains much higher Ti content and η-phase fraction.

Microstructure

The microstructure of the subject alloys can be characterized as having a predominantly lath martensitic matrix. A fine MC phase grain-pinning dispersion of spherical to cube-shaped particles located at grain boundaries with a size less than 5 μm and preferably less than 1 μm. Within the martensitic matrix the subject alloys are characterized as being predominantly free of TCP-phases and predominantly strengthened by a dispersion of η-phase particles. The dispersion of η phase particles constitute about 2 to 8% by volume and grow to a rod-shaped morphology with a long dimension of less than 50 nm and preferably less than about 10 nm for the highest strength embodiments.

N, O, S, and P can form undesirable inclusions that have a negative effect on fatigue resistance and toughness. S, P, and other tramp elements can cause grain boundary embrittlement, and thereby increase the alloy susceptibility to SCC. Consequently, these are minimized in the subject—alloys.

Microsegregation can be a problem for alloy-rich compositions. Composition in homogeneities can result in low-melting temperature pools of liquid within the cast ingot. The examples of M52S-2A and 2B (Table 4) were unsuitable for forging due to excessive alloy Ti content. Mo content should also be controlled to avoid undesirable incipient melting. M45S-2A and M48S-2A (Table 4) have been demonstrated at an intermediate-scale without segregation problems.

A fine grain size is required for strength, toughness and corrosion resistance. To prevent undesirable grain growth during solution treatment, a dispersion of MC particles is utilized in the subject invention, where M may be Ti, V, Nb, or Ta. The grain-pinning efficiency of the MC particle dispersion is improved for a refined particle size, which is achieved via C dissolution during the aforementioned homogenization process and subsequent precipitation during forging. The TiC particles are spherical to cube-shaped, located at grain boundaries, less than 5 μm and preferably less than about 1 μm, and constitute about 0.02 to 0.15% by volume.

A lath martensitic matrix is needed for good strength and toughness. Retained austenite will reduce the strength of the alloy, and should be less than about 15% by volume. As a result, a FCC single-phase field, without delta ferrite, is required at the homogenization temperature. This requirement is a concern for alloys with high Cr, Mo, and W contents. It has been discovered that the addition of Co to the M45S-1A can promote the high temperature austenite single-phase field, as shown in FIG. 6.

Upon quenching from high temperature the alloy should have an $M_S$ above room temperature and preferably above 50° C. to eliminate the need for cryogenic treatment. Ni, Cr, Mo, Cu, and W should be carefully controlled. FIG. 7 illustrates the relationship between $M_S$ and volume fraction of retained austenite. M48S-2A and M52S-1B (Table 4) are examples of alloys with too low $M_S$ and correspondingly high retained austenite A tempering process between 450 to 550° C. precipitates a dispersion of intermetallic particles within the martensitic matrix. The aforementioned η-phase is the principal strengthening particle of the subject new alloys. The solubility of Al in the η-phase, as shown in FIG. 8, is also utilized in the subject alloys. Depending upon the Ti/Al ratio in the alloy, some supplemental B2-NiAl strengthening is expected. The η-phase particle size is minimized in the subject alloys by incorporating Co in the alloys, which increases the thermodynamic driving force for precipitation. Reduced tempering temperature also increases the thermodynamic driving force for η-phase precipitation. The η phase particles have a predominantly rod-shaped morphology with the long dimension less than 50 nm and preferably less than about 10 nm for the highest strength embodiments. The phase fraction of the n phase can range from about 2 to 8% by volume.

TCP-phases are avoided during tempering due to their aforementioned detrimental effects on alloy performance. Reduced tempering temperature and elevated W, Mo, Co, Cu, and Cr would increase the stability of TCP-phases. The M45S alloy embodiment of the subject invention is most susceptible to precipitation of TCP-phases, and therefore the preferred tempering temperature for this alloy is above 500° C.

Austenite may also precipitate during tempering, which results in decreased alloy hardness. Austenite precipitation is promoted by increase alloy Ni and Co content and elevated tempering temperature. Limited austenite precipitation is acceptable, however, excessive austenite precipitation can rapidly decrease the alloy strength. FIG. 9 illustrates the volume fraction of austenite with tempering time and the associated decrease in hardness for M52S-1A at three tempering temperatures.

Cu is avoided because it is known to co-nucleate with η-phase precipitates [Hattestrand, M. et al., 2004 *Acta Materialia,* 52, 1023-1037], and for such non-shearable Orowan dislocation obstacles, co-nucleation provides little strengthening benefit, especially considering the associated depression of $M_S$. Coherent precipitates of bcc-Cr and B2-NiAl precipitate nucleate independently of η-phase particles and may provide supplemental strengthening. Care must be taken to avoid consuming too much Ni from the matrix with excessive B2-NiAl.

TCP phases such as mu, laves, R, and sigma phase should be essentially avoided. Due to their low crystalline symmetry, these phases have a kinetic disadvantage for precipitation compared to previously discussed strengthening phases. Therefore, they can be thermodynamically stable so long as their driving force for precipitation is low enough to delay precipitation until after the precipitation of more desirable phases. Generally, TCP phase precipitation is promoted by W, Mo, Cr, Cu, and Co and reduced tempering temperatures. Acceptable alloying element limits and associated tempering temperatures have been developed as represented by examples discussed hereinafter.

Finally, austenite precipitation may occur during tempering. Increased alloy Ni content and increased tempering temperatures promote precipitation of austenite. Limited austenite precipitation is acceptable, however, excessive austenite precipitation can rapidly decrease the alloy strength. Less than about 15% retained austenite is deemed acceptable, thus making the alloy primarily martensitic.

A fine grain size is required for strength, toughness and corrosion resistance. To prevent undesirable grain growth during solution treatment, a dispersion of TiC particles is utilized in the subject invention. The grain-pinning efficiency of the TiC particle dispersion is improved for a refined particle size, which is achieved via C dissolution during the homogenization process and subsequent precipitation during forging. The requirement for TiC solubility is achieved by limiting the TiC and C contents as shown in FIG. 5 for a selected homogenization temperature. A temperature range of about 1200 to 1250° C. has been discovered as an optimal temperature for 0.5 to 0.75 wt % Ti and 20 to 150 wppm of C and preferably 50 to 100 wppm of carbon.

Due to the balance of Ti, Ni, Al, and Co for optimal η-phase strengthening response; W, Mo, Co, Cu, and Cr to avoid detrimental TCP-phase precipitation; and Ni and Co to control austenite precipitation, overall alloy composition and tempering temperature should be carefully balanced to achieve the desired alloy performance. Table 4 shows compositions of examples of the subject invention and examples of compositions that do not meet one or more requirements. Table 5 shows tempering conditions of alloy examples and their corresponding properties. These examples illustrate the possible composition and tempering temperature trade-offs that are possible to achieve desired strength, toughness, and corrosion resistance.

EXAMPLES

TABLE 4

Compositions of experimental alloys tested to date in wt %, with the balance essentially Fe and incidental elements and impurities. Italicized composition indicates it is outside the preferred composition range.

| Alloy | Ni | Cr | Co | Mo | Ti | Al | C | Other |
|---|---|---|---|---|---|---|---|---|
| M52S-1A | 11.91 | *7.74* | 9.95 | 0.98 | 0.71 | 0.27 | 0.010 | |
| M52S-1B[1] | *15.46* | 8.87 | 7.39 | 0 | *0.80* | 0.09 | N/A | |
| M52S-2A[2] | 11.95 | 8.14 | 10.48 | 0 | *1.11* | 0.39 | 0.006 | |
| M52S-2B[3] | 13 | 8 | 7 | *0.3* | *1.5* | 0.4 | N/A | |
| M52S-2C | 13.45 | 8.67 | 13.9 | 0.82 | 0.57 | 0.39 | 0.003 | |
| M52S-2D | 10.81 | 8.84 | 9.24 | 1.19 | 0.57 | 0.43 | 0.014 | 0.41 V |
| M48S-1A | 10.25 | 11.85 | 7.48 | 1.47 | 0.56 | 0.43 | 0.004 | |
| M48S-1B | 10.00 | 11.11 | 7.51 | 1.23 | 0.59 | 0.57 | 0.004 | 0.28 W |
| M48S-2A[4] | 10.5 | 12.4 | 7.6 | 1.5 | 0.6 | 0.4 | *0.001* | |
| M45S-1A | 8.3 | 14.3 | 4.3 | 2.6 | 0.49 | 0.1 | 0.002 | |
| M45S-2A | 8.4 | 14.3 | 4.3 | 2.5 | 0.47 | 0.12 | 0.003 | |

[1]Alloy did not transform to martensite due to excessive Ni content
[2]Alloy suffered from hot shortness during forging due to excessive Ti content
[3]Alloy suffered from hot shortness during forging due to excessive Ti content
[4]Alloy had excessive retained austenite due to too much combined Ni and Cr content and insufficient C

TABLE 5

Yield strength, tensile strength, CVN impact toughness, and hardness for experimental alloys

| Alloy | Aging Temperature | Aging Time | YS (ksi) | UTS (ksi) | CVN (ft · lb) | Hardness (Rc) |
|---|---|---|---|---|---|---|
| M48S-1A | 482° C. | 4 hrs | 229 | 243 | 41 | 49.2 |
| M48S-1A | 482° C. | 4 hrs | 234 | 247 | 40 | 49.4 |
| M48S-1A | 482° C. | 32 hrs | 240 | 254 | 33 | 50.5 |
| M48S-1A | 482° C. | 32 hrs | 245 | 256 | 38 | 49.4 |
| M48S-1A | 520° C. | 1 hr | 221 | 231 | 57 | 48.0 |
| M48S-1A | 520° C. | 1 hr | 219 | 230 | 56 | 48.0 |
| M48S-1A | 520° C. | 2 hrs | 224 | 237 | 51 | 48.5 |
| M48S-1B | 450° C. | 20 hrs | 253 | 266 | 12 | 53.2 |
| M48S-1B | 450° C. | 20 hrs | 255 | 268 | 16 | 53.0 |
| M48S-1B | 482° C. | 6 hrs | 250 | 262 | 30 | 51.5 |
| M48S-1B | 482° C. | 6 hrs | 246 | 259 | 29 | 51.1 |
| M52S-1A | 432° C. | 48 hrs | 267 | 280 | 6 | 53.3 |
| M52S-1A | 432° C. | 48 hrs | 266 | 278 | 7 | 53.5 |
| M52S-1A | 450° C. | 32 hrs | 263 | 276 | 8 | 53.2 |
| M52S-1A | 450° C. | 32 hrs | 265 | 277 | 8 | 52.9 |
| M52S-1A | 450° C. | 48 hrs | 269 | 279 | 7 | 53.4 |
| M52S-1A | 450° C. | 48 hrs | 269 | 280 | 9 | 53.4 |
| M52S-1A | 468° C. | 32 hrs | 264 | 274 | 9 | 52.9 |
| M52S-1A | 468° C. | 32 hrs | 265 | 275 | 8 | 52.8 |
| M52S-1A | 510° C. | 4 hrs | 228 | 238 | 26 | 48.2 |
| M52S-1A | 510° C. | 4 hrs | 227 | 237 | 26 | 48.5 |
| M52S-2A | 482° C. | 1 hr | 253 | 265 | 19 | 50.8 |
| M52S-2A | 482° C. | 1 hr | 255 | 266 | 20 | 50.8 |
| M52S-2A | 482° C. | 16 hrs | 271 | 279 | 11 | 52.7 |
| M52S-2A | 482° C. | 16 hrs | 272 | 281 | 11 | 52.7 |
| M52S-2A | 520° C. | 1 hr | 253 | 262 | 21 | 51.5 |
| M52S-2A | 520° C. | 1 hr | 254 | 263 | 21 | 51.5 |
| M52S-2A | 520° C. | 4 hrs | 253 | 260 | 18 | 51.2 |
| M52S-2A | 520° C. | 4 hrs | 254 | 262 | 18 | 51.2 |
| M52S-2A | 520° C. | 16 hrs | 253 | 260 | 16 | 50.3 |
| M52S-2A | 520° C. | 16 hrs | 248 | 256 | 17 | 50.3 |
| M52S-2C | 482° C. | 8 hrs | 256 | 280 | 14 | 51.7 |
| M52S-2C | 482° C. | 8 hrs | 259 | 280 | 10 | 52.7 |
| M52S-2C | 510° C. | 2 hrs | 241 | 255 | 19 | 51.7 |
| M52S-2D | 450° C. | 32 hrs | 264 | 274 | 14 | 52.7 |
| M52S-2D | 450° C. | 32 hrs | 268 | 278 | 9 | 52.4 |

TABLE 5-continued

Yield strength, tensile strength, CVN impact toughness, and hardness for experimental alloys

| Alloy | Aging Temperature | Aging Time | YS (ksi) | UTS (ksi) | CVN (ft · lb) | Hardness (Rc) |
|---|---|---|---|---|---|---|
| M52S-2D | 500° C. | 8 hrs | 243 | 251 | 29 | 50.1 |
| M52S-2D | 500° C. | 8 hrs | 244 | 254 | 25 | 50.2 |
| M45S-1A | 527° C. | 2 hrs | 195 | 214 | 87 | 44.7 |
| M45S-1A | 527° C. | 2 hrs | 197 | 215 | 77 | 45.2 |
| M45S-2A | 527° C. | 2 hrs | 185 | 196 | 130 | 42.6 |
| M45S-2A | 527° C. | 2 hrs | 185 | 195 | 136 | 42.5 |

In any event an objective of the subject matter of the invention is to provide a composition of elements processed to achieve the characterized microstructure and thereby achieve improved physical parameters of strength, toughness and corrosion resistance. Alternative processing means may be employed to achieve the desired microstructural characteristics for the claimed alloy. Also certain variations and substitutions of elements may be available. Thus, the invention is to be limited only by the following claims and equivalents thereof.

What is claimed is:

1. A stainless steel alloy comprising, in combination, by weight about: 0.002 to 0.015 carbon (C), 2 to 15% cobalt (Co), 7.0 to 14.0% nickel (Ni), 8.0 to 15.0% chromium (Cr), 0.5 to 2.6% molybdenum (Mo), 0.45 to 0.75% titanium (Ti), 0.5% tungsten (W), 0.7% aluminum (Al), and the balance essentially iron (Fe) and incidental elements and impurities, characterized in that the alloy avoids copper (Cu) as an alloying constituent, has a predominantly lath martensite microstructure having been quenched from high temperature at below a TiC solvus temperature in a TiC+FCC two-phase field without requiring cold work, essentially without topologically close packed (TCP) intermetallic phases and said carbon (C) is in a dispersion of 0.02 to 0.15% by volume TiC carbide particles and further including a dispersion of intermetallic particles primarily of $Ni_3Ti$ η phase as a strengthening phase.

2. The alloy of claim 1 further including a dispersion of coherent particles selected from the group consisting of Bcc-Cr and B2-NiAl particles.

3. The alloy of claim 1 further including a grain pinning dispersion of MC carbide particles where M is selected from the group consisting of V, Nb and Ta.

4. The alloy of claim 1 processed to a yield strength greater than 180 ksi, a CVN toughness of at least about 10 foot pounds and a corrosion resistance (PREN) at least about 10, such that CVN (ft-lbs)+0.85*yield strength (ksi) is greater than about 240.

5. The alloy of claim 1 comprising by weight about: 8 to 11% Cr, 10 to 14% Ni, 6 to 15% Co, 0.2 to 0.7% Al, 0.002 to 0.015 C, less than 0.4% Cu, 0.5 to 1.5% Mo, up to 0.5 W, and 0.55 to 0.75% Ti and the balance essentially Fe and incidental elements and impurities.

6. The alloy of claim 1 comprising by weight about: 10 to 13% Cr, 8.5 to 11% Ni, 4 to 10% Co, less than 0.4% Cu, 1 to 2% Mo, up to 0.5% W, 0.45 to 0.65% Ti, 0.2 to 0.6% Al, 0.002 to 0.015 C and the balance essentially Fe and incidental elements and impurities.

7. The alloy of claim 1 comprising by weight about: 12 to 15% Cr, 7 to 10% Ni, 2 to 8% Co, less than 0.4% Cu, 1.5 to 2.56% Mo, up to 0.5% W, 0.4 to 0.6% Ti, up to 0.4% Al, 0.002 to 0.015% C and the balance essentially Fe and incidental elements and impurities.

8. The alloy of claim 1 processed by homogenization to a single Fcc phase and subsequently cooled below an $M_s$ temperature of about 50° C. and tempered to form an essentially lath martensite microstructure including intermetallic $\eta$-$Ni_3Ti$ particles and TiC particles wherein the volume fraction of retained austenite is less than about 15%.

9. The alloy of claim 1 wherein the $\eta$-$Ni_3Ti$ intermetallic phase constitutes about 2 to 8% by volume.

10. The alloy of claim 1 wherein the particle size and shape of the $\eta$-$Ni_3Ti$ intermetallic phase is characterized as rod shaped with the long dimension less than about 50 nm.

11. The alloy of claim 1 wherein the particle size of the TiC is characterized as spherical to cube-shaped, located at grain boundaries, and less than about 5 μm.

12. The alloy of claim 1 wherein the TiC particles comprise a grain pinning dispersion.

13. The alloy of claim 3 wherein the TiC particles comprise a grain pinning dispersion.

14. The alloy of claim 1 wherein the alloy has a predominantly lath martensite microstructure, with a martensite phase constitution of greater than about 85% having been quenched from high temperature without requiring cold work.

15. The alloy of claim 1 wherein the alloy has a predominantly lath martensite microstructure, with a martensite phase constitution of greater than about 90% having been quenched from high temperature without requiring cold work.

16. The alloy of claim 1 comprising by weight about: 0.002 to 0.015 C, 2 to 15% Co, 7.0 to 14.0% Ni, 8.0 to 15.0% Cr, 0.5 to 2.6% Mo, 0.45 to 0.65% Ti, less than about 0.5% W, less than about 0.7% Al, and the balance essentially Fe and incidental elements and impurities.

17. The alloy of claim 1 comprising by weight about: 0.002 to 0.015 C, 4 to 15% Co, 7.0 to 14.0% Ni, 8.0 to 15.0% Cr, 0.5 to 2.6% Mo, 0.45 to 0.65% Ti, less than about 0.5% W, less than about 0.7% Al, and the balance essentially Fe and incidental elements and impurities.

18. A stainless steel alloy comprising, in combination, by weight about: 0.002 to 0.015 C, 2 to 15% Co, 7.0 to 14.0% Ni, 8.0 to 15.0% Cr, 0.5 to 2.6% Mo, 0.45 to less than about 0.75% Ti, less than about 0.5% W, less than about 0.7% Al, and the balance essentially Fe and incidental elements and impurities, characterized in that the alloy avoids Cu as an alloying constituent, has a predominantly lath martensite microstructure wherein the volume fraction of retained austenite is less than about 15% having been quenched from high temperature at below a TiC solvus temperature in a TiC+FCC two-phase field and tempered without requiring cold work, essentially without TCP intermetallic phases and said C is in a dispersion of 0.02 to 0.15% by volume TiC carbide particles and further including a dispersion of intermetallic particles primarily of $Ni_3Ti$ $\eta$ phase as a strengthening phase.

19. The alloy of claim 17 comprising by weight about: 0.002 to 0.015 C, 2 to 15% Co, 7.0 to 14.0% Ni, 8.0 to 15.0% Cr, 0.5 to 2.6% Mo, 0.45 to 0.65% Ti, less than about 0.5% W, less than about 0.7% Al, and the balance essentially Fe and incidental elements and impurities.

20. The alloy of claim 1 wherein the particle size and shape of $\eta$-$Ni_3Ti$ intermetallic phase is characterized as rod shaped with the long dimension less than about 10 nm.

* * * * *